United States Patent [19]

Jackman

[11] 4,060,407

[45] Nov. 29, 1977

[54] METHODS AND APPARATUS FOR ADDING MISCHMETAL TO MOLTEN STEEL

[75] Inventor: Joseph R. Jackman, West Pittsburgh, Pa.

[73] Assignee: Reactive Metals & Alloys Corporation, West Pittsburgh, Pa.

[21] Appl. No.: 744,123

[22] Filed: Nov. 22, 1976

Related U.S. Application Data

[62] Division of Ser. No. 607,625, Aug. 25, 1975, Pat. No. 4,022,444.

[51] Int. Cl.[2] ..... C21C 7/00; C22C 23/06

[52] U.S. Cl. ..... 75/58; 75/53; 75/93 G; 75/130 R; 75/130 B; 75/152

[58] Field of Search ..... 75/53, 58, 130 R, 130 B, 75/152, 93 G

[56] References Cited

U.S. PATENT DOCUMENTS

| | | | |
|---|---|---|---|
| 2,397,418 | 3/1946 | Howard | 75/93 G |
| 2,792,300 | 5/1957 | Livingston | 75/130 |
| 3,921,700 | 11/1975 | Frantzreb | 75/130 B |

*Primary Examiner*—P. D. Rosenberg

*Attorney, Agent, or Firm*—Buell, Blenko & Ziesenheim

[57] ABSTRACT

A method, apparatus and alloy for adding mischmetal to molten steel by filling a metal canister with a mischmetal-magnesium alloy in the range 1% to 2.5% magnesium, plunging the metal canister beneath the surface of the steel bath being treated and holding the canister submerged in the bath until the mischmetal has dissolved.

7 Claims, 5 Drawing Figures

METHODS AND APPARATUS FOR ADDING MISCHMETAL TO MOLTEN STEEL

This application is a division of my copending application Ser. No. 607,625, filed Aug. 25, 1975 now U.S. Pat. No. 4,022,444.

The use of mischmetal as an additive in steelmaking practices has been known for many years. More recently it has had an incrased impetus in its use by the discovery of sulfide shape control by its use in (HSLA) high strength low alloy steels. Ladle additions of rare earth silicide during tapping has been the prevalent practice in the steel industry for making rare earth metal additions, particularly in heavy plate and line pipe application. The recovery of rare earths is generally less than satisfactory and subsurface defects and alloying difficulties have been problems to the industry.

I have discovered that the recovery of rare earths can be markedly improved and the subsurface defects and alloying problems generally associated with rare earth silicide additions in the past can be eliminated by plunging a mischmetal-magnesium alloy contained in a canister of particular design into the body of molten steel and maintaining it submerged until dissolved. I have found that the amount of magnesium present in the alloy must be maintained below about 2.5%. The magnesium percentage is extremely important as it is used to generate a stirring or "boiling" action to uniformly distribute the rare earths.

The practice of my invention generally comprises pouring a mischmetal-magnesium alloy having about 1% to 2.5% magnesium, preferably about 1.75% to 2% magnesium, into an elongated steel canister having a central rod fixed to the top thereof and provided with spaced anchor means or reinforcing rods or fingers along its length, closing the canister about the alloy, suspending the alloy containing canister on the end of a solid rod, usually a 10 inch × 10 inch bloom, and plunging said rod and canister beneath the surface of a molten bath of steel to be treated and holding the same in said bath until the mischmetal-magnesium alloy is dissolved in the molten metal.

In the foregoing general description of this invention I have outlined certain objects, purposes and advantages. Other objects, purposes and advantages of the invention will be apparent from the following description and the accompanying drawings in which.

Figure 1:
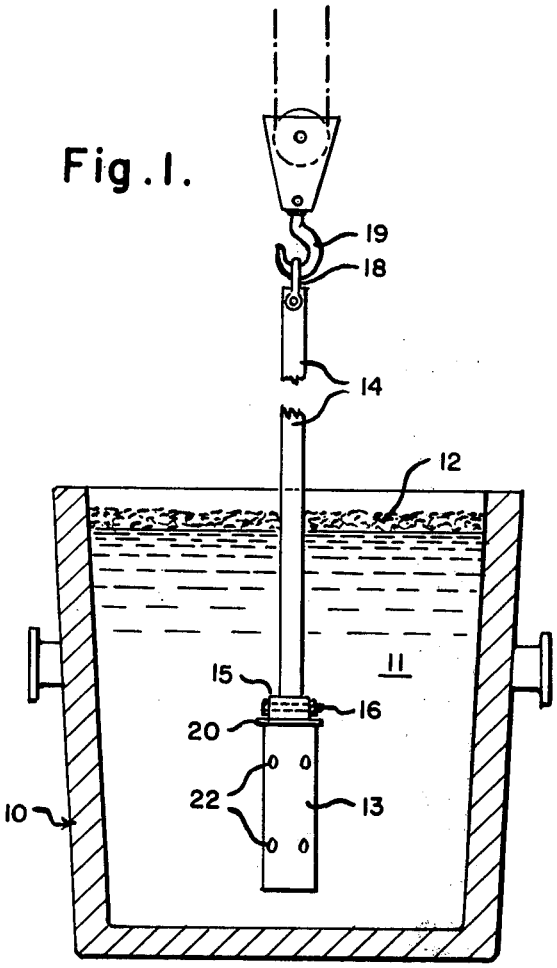
FIG. 1 is a section through a ladle showing the canister of this invention plunged into molten metal to be treated.
Figure 2:
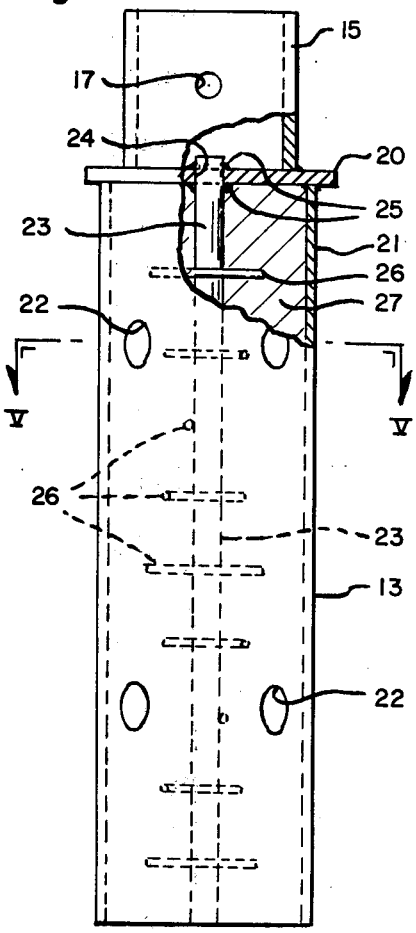
FIG. 2 is a side elevation of a canister as used in this invention.
Figure 3:
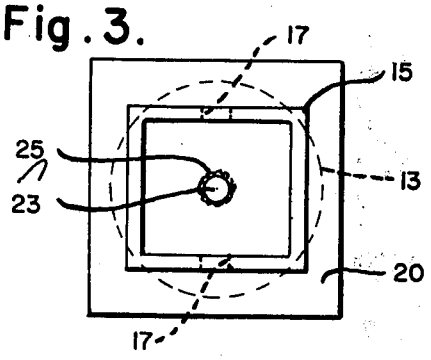
FIG. 3 is a top end view of the canister of FIG. 2.
Figure 5:
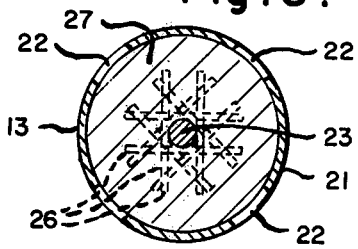
FIG. 5 is a section on the line V—V of FIG. 2.
Figure 4:
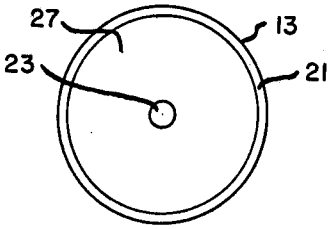
FIG. 4 is a bottom end view of the canister of FIG. 2.

Referring to the drawings I have illustrated a ladle 10 containing a molten bath of steel 11 covered by slag 12. A canister 13 filled with the mischmetal-magnesium alloy of my invention is fastened on the end of an elongated bloom 14 by inserting one end of bloom 14 into socket 15 on the head of canister 13 and inserting a bolt 16 through holes 17 in the socket 15 and in the end of the bloom within the socket. The other end of bloom 14 is provided with a clevis 18 which is suspended on hook 19 of a hoist so as to permit movement of the bloom and canister to the ladle and lowering it therein. The canister 13 is provided with a relatively heavy walled top plate 20 on which socket or steel box 15 is fixed and from which the canister shell 21 is fastened by welding. The canister shell is preferably perforated with spaced holes 22. An axial rod 23 depends from top plate 20 and is preferably welded into hole 24 in the center of the top by a double weldment 25. The rod 23 is provided with spaced radial fingers 26 along its length. The mischmetal-magnesium alloy 27 is poured, in the molten state, into canister 13 around rod 23 and solidifies therein, engaging the fingers 26.

The shell 21 and fingers 26 act to hold the mischmetal-magnesium alloy beneath the surface of the molten metal and prevent pieces of it from breaking away and floating to the surface.

The mischmetal-magnesium alloy 27 is made up of about 1% to 2.5% magnesium with the balance being mischmetal and impurities. Preferably the amount of magnesium is maintained in the narrower range 1.75% to 2%. The mischmetal composition is preferably about 45% to 51% cerium, about 23 to 26% lanthanum, about 15 to 19% neodymium, about 4 to 6% praseodymium and about 1 to 2% other rare earths with a maximum of about 3% iron as an impurity together with small amounts of other impurities.

I have found that sulfur levels in steel can be reduced to about 0.009 from 0.018 using the technique of this invention with recoveries of up to 75% of the rare earths added. In the past it has not been unusual for the mischmetal addition to be totally ineffective in ladle additions which led to the virtual abandonment of mischmetal ladle additions to steel for some time prior to my invention.

I have found that for best results the ladle glaze should be high in CaO and MgO and low in FeO and MnO. This can be accomplished by gunning the ladle with a basic refractory mixture. The ladle slag should have a V-ratio of at least 3.0 for best results and the steel bath should preferably be aluminum killed with an aluminum residual of at least 0.040%.

The foregoing specification describes certain preferred practices and embodiments of my invention, however, it will be understood that this invention may be otherwise embodied within the scope of the following claims.

I claim:

1. The method of adding mischmetal to steel comprising the steps of:

a. forming a composite article consisting essentially of a metal canister filled with a mischmetal-magnesium alloy in which the magnesium is present in an amount sufficient to generate stirring in a molten steel bath to which it is added in the range 1% to 2.5% and the balance is mischmetal, b. plunging the metal canister containing mischmetal magnesium alloy beneath the surface of a molten steel bath being treated, and c. holding the metal canister beneath the surface of the steel bath until the canister and mischmetal-magnesium alloy is dissolved.

2. A method as claimed in claim 1 wherein the canister has a central rod having radial fingers imbebbed in the mischmetal-magnesium alloy, fixing the alloy firmly within the canister.

3. A method as claimed in claim 1 wherein the molten steel bath is contained in a ladle having a ladle glaze adjusted to be high in CaO and MgO.

4. A method as claimed in claim 1 wherein the molten steel bath is contained in a ladle having a slag adjusted to a V-ratio in excess of 3.0.

5. A method as claimed in claim 1 wherein the steel bath being treated has a residual aluminum content of not less than 0.040.

6. A rare earth addition alloy consisting essentially of about 1 to 2.5% magnesium and the balance mischmetal with ordinary impurities.

7. A rare earth addition alloy as claimed in claim 6 wherein the magnesium is about 1.75% to 2%.

* * * * *

UNITED STATES PATENT OFFICE

CERTIFICATE OF CORRECTION

Patent No. 4,060,407 Dated November 29, 1977

Inventor(s) JOSEPH R. JACKMAN

It is certified that error appears in the above-identified patent and that said Letters Patent are hereby corrected as shown below:

Column 2, Claim 2, line 63, "imbebbed" should read --imbedded--.

Signed and Sealed this

*Twenty-third* Day of *May 1978*

[SEAL]

*Attest:*

RUTH C. MASON
*Attesting Officer*

LUTRELLE F. PARKER
*Acting Commissioner of Patents and Trademarks*